US011261702B2

(12) United States Patent
Machocki

(10) Patent No.: US 11,261,702 B2
(45) Date of Patent: Mar. 1, 2022

(54) DOWNHOLE TOOL ACTUATORS AND RELATED METHODS FOR OIL AND GAS APPLICATIONS

(71) Applicant: Saudi Arabian Oil Company, Dhahran (SA)

(72) Inventor: Krzysztof Karol Machocki, Scotland (GB)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/855,806

(22) Filed: Apr. 22, 2020

(65) Prior Publication Data

US 2021/0332670 A1 Oct. 28, 2021

(51) Int. Cl.
*E21B 23/01* (2006.01)
*E21B 34/14* (2006.01)

(52) U.S. Cl.
CPC ..... *E21B 34/14* (2013.01); *E21B 23/01* (2013.01); *E21B 2200/06* (2020.05)

(58) Field of Classification Search
CPC .... E21B 23/01; E21B 23/004; E21B 23/0411; E21B 34/14; E21B 2200/06
See application file for complete search history.

(56) References Cited

U.S. PATENT DOCUMENTS 2,043,225 A 6/1936 Armentrout et al.
2,227,729 A * 1/1941 Lynes ..... E21B 33/1243 166/106
4,075,858 A * 2/1978 Frederick ..... E02D 7/10 405/228
RE32,345 E 3/1987 Wood
5,803,186 A 9/1998 Berger et al.
6,047,239 A 4/2000 Berger et al.
6,622,554 B2 9/2003 Manke et al.
6,741,000 B2 5/2004 Newcomb
7,086,463 B2 8/2006 Ringgenberg et al.
7,124,819 B2 10/2006 Ciglenec et al.
7,647,980 B2 1/2010 Corre et al.
(Continued)

FOREIGN PATENT DOCUMENTS

CA 1226325 9/1987
CA 2249432 9/2005
(Continued)

OTHER PUBLICATIONS

Schlumberger, "CERTIS: Retrievable, single-trip, production-level isolation system," www.slb.com/CERTIS, 2017, 2 pages.
(Continued)

*Primary Examiner* — Cathleen R Hutchins
(74) *Attorney, Agent, or Firm* — Fish & Richardson P.C.

(57) ABSTRACT

A downhole tool actuator includes a housing defining an axial bore and a first port extending radially from the axial bore, as well as a piston disposed and movable within the axial bore of the housing. The piston includes a receptacle wall, a shaft extending axially from the receptacle wall, and a contact member extending across the shaft. The receptacle wall defines a chamber and a second port extending radially from the chamber. The contact member is positioned outside of the housing and is configured to engage a downhole tool.

20 Claims, 11 Drawing Sheets

(56) References Cited

U.S. PATENT DOCUMENTS

| | | | |
|---|---|---|---|
| 8,067,865 | B2 | 11/2011 | Savant |
| 8,973,680 | B2 | 3/2015 | MacKenzie |
| 9,051,810 | B1 | 6/2015 | Cuffe et al. |
| 9,238,953 | B2 | 1/2016 | Fleming et al. |
| 9,238,961 | B2 | 1/2016 | Bedouet |
| 9,494,010 | B2 | 11/2016 | Flores |
| 10,329,877 | B2 | 6/2019 | Simpson et al. |
| 10,392,910 | B2 | 8/2019 | Walton et al. |
| 2005/0022987 | A1 | 2/2005 | Green et al. |
| 2006/0248949 | A1 | 11/2006 | Gregory et al. |
| 2008/0053652 | A1 | 3/2008 | Corre et al. |
| 2010/0006339 | A1 | 1/2010 | Desai |
| 2011/0155368 | A1 | 6/2011 | El-Khazindar |
| 2014/0265337 | A1 | 9/2014 | Harding et al. |
| 2014/0300895 | A1 | 10/2014 | Pope et al. |
| 2015/0027724 | A1 | 1/2015 | Symms |
| 2018/0245426 | A1* | 8/2018 | Strohla ..... E21B 33/14 |
| 2018/0334883 | A1 | 11/2018 | Williamson |

FOREIGN PATENT DOCUMENTS

| | | |
|---|---|---|
| CA | 2594042 | 8/2012 |
| DE | 102008001607 | 11/2009 |
| DE | 102012022453 | 5/2014 |
| DE | 102013200450 | 7/2014 |
| DE | 102012205757 | 8/2014 |
| GB | 2306986 | 5/1997 |
| GB | 2388854 | 11/2003 |
| GB | 2514170 | 11/2014 |
| JP | 2013110910 | 6/2013 |
| RU | 122531 | 11/2012 |
| WO | 9721904 | 6/1997 |
| WO | 2014127035 | 8/2014 |
| WO | WO 2016183405 | 11/2016 |
| WO | 2017196303 | 11/2017 |
| WO | 2018022198 | 2/2018 |

OTHER PUBLICATIONS

Weatherford, "RFID Advanced Reservoir Management System Optimizes Injection Well Design, Improves Reservoir Management," Weatherford.com, 2013, 2 pages.

Wellbore Service Tools: Retrievable tools, "RTTS Packer," Halliburton: Completion Tools, 2017, 4 pages.

PCT International Search Report and Written Opinion in International Appln. No. PCT/US2021/028590, dated Jun. 22, 2021, 13 pages.

* cited by examiner

DOWNHOLE TOOL ACTUATORS AND RELATED METHODS FOR OIL AND GAS APPLICATIONS

TECHNICAL FIELD

This disclosure relates to downhole tool actuators and related methods of moving a downhole tool out of a hydraulically locked position.

BACKGROUND

During certain operations performed at a wellbore, downhole systems within the wellbore may be activated by an actuator (for example, a ball or a dart) that has been dropped from the surface of the wellbore and subsequently lands on a designated seat of a piston of the downhole system. With the aid of a fluid pressure difference applied from the surface of the wellbore to force the actuator downward, the actuator will apply a force to the piston of the downhole system to move the piston from a first axial position at which the piston may be deactivated and/or may facilitate one or more first processes to a second axial position at which the piston may be activated and/or may facilitate one or more second processes at the wellbore.

In order to move the piston from the first axial position to the second axial position, fluid below the piston must be displaced upward to provide space for accommodating the piston as the piston travels downward. However, in some instances, the actuator, landed on the seat of the piston, seals a first region below the piston from a second region above the piston at a state in which a fluid pressure in the first region equals a fluid pressure in the second region, thereby placing the piston in a hydraulically locked position in which the piston is deactivated. In the hydraulically locked position, fluid above the piston is unable to compress fluid below the piston, thereby locking the piston in a fixed position and preventing the piston from moving to the second axial position to facilitate intended operations at the second axial position.

Furthermore, due to the hydraulic lock, any additional actuator that would need to be dropped from the surface for further shifting the piston to a third axial position can no longer be pumped to the piston, but rather would only be able to passively gravitate to the piston. Once hydraulically locked, interventions may be undertaken to manually to push the piston downward. However, such interventions run the risk of overshooting the piston, that is, pushing the piston from the first axial position, past the second axial position, and directly to the third axial position in one stroke, and consequently bypassing the second axial position inadvertently.

SUMMARY

This disclosure relates to a tool actuator that is designed to activate a downhole piston that has become lodged in a hydraulically locked position. In some embodiments, the tool actuator includes a housing and an actuator piston that is movable axially within an axial bore of the housing to apply a downward force to the downhole piston for shifting the downhole piston out of the hydraulically locked position. The housing defines multiple fluid circulation ports that permit fluid communication between the axial bore of the housing and an annulus defined between the housing and a surrounding casing or formation wall.

The actuator piston includes a fluid chamber that defines multiple fluid circulation ports that may be aligned axially with the fluid circulation ports of the housing to permit fluid communication between the fluid chamber and the axial bore of the housing. The actuator piston also includes multiple circumferential seals that are carried on the fluid chamber for isolating the fluid circulation ports on the fluid chamber from the fluid circulation ports on the housing to prevent fluid communication between the fluid chamber and the axial bore of the housing. The actuator piston further includes an actuation arm that extends from the fluid chamber and past the housing for actuating the downhole piston. The actuation arm provides a contact surface at which the actuator piston contacts the downhole piston to move the downhole piston out of the locked position in a controlled manner.

In one aspect, a downhole tool actuator includes a housing defining an axial bore and a first port extending radially from the axial bore, as well as a piston disposed and movable within the axial bore of the housing. The piston includes a receptacle wall, a shaft extending axially from the receptacle wall, and a contact member extending across the shaft. The receptacle wall defines a chamber and a second port extending radially from the chamber. The contact member is positioned outside of the housing and is configured to engage a downhole tool.

Embodiments may provide one or more of the following features.

In some embodiments, the housing further defines a stopper disposed within the axial bore at a downhole end of the axial bore.

In some embodiments, axial movement of the piston within the axial bore is limited by the stopper.

In some embodiments, the contact member is oriented horizontally.

In some embodiments, the contact member is wider than the housing.

In some embodiments, the contact member defines multiple slots that extend radially with respect to the shaft.

In some embodiments, the piston further includes a first seal carried on the receptacle wall and a second seal carried on the receptacle wall, the first seal positioned above the second port and the second seal positioned below the second port.

In some embodiments, the piston is movable to a first position at which the second port is located above the first port and the first and second seals block fluid communication between the first and second ports and a second position at which the second port is axially aligned with the first port such that the fluid chamber is in fluid communication with a region outside of the housing.

In some embodiments, the housing defines multiple first ports that are spaced about a circumference of the housing and the receptacle wall defines multiple second ports that are spaced about a circumference of the receptacle wall.

In some embodiments, the multiple first ports are radially aligned with the multiple second ports.

In some embodiments, the downhole tool actuator further includes a locking mechanism that is configured to secure the receptacle wall of the piston to the housing.

In some embodiments, the locking mechanism includes a pin that is disposed within the housing and the receptacle wall.

In some embodiments, the downhole tool actuator further includes a connector extending from the housing and configured to be coupled to a running tool, the connector defining a channel that fluidly communicates with the axial bore of the housing.

In some embodiments, the downhole tool actuator further includes an anchor tool extending from the housing and configured to secure the housing to an exterior wall surrounding the housing, the anchor tool defining a channel that fluidly communicates with the axial bore of the housing.

In another aspect, a method of moving a downhole tool includes determining that the downhole tool is hydraulically locked at a first axial position within a pipe and deploying a tool actuator to the downhole tool. In some embodiments, the tool actuator includes a housing defining an axial bore and a first port extending radially from the axial bore and a piston disposed within the axial bore of the housing. In some embodiments, the piston includes a receptacle wall defining a chamber and a second port extending radially from the chamber and an actuation arm extending axially from the receptacle wall. The method further includes delivering a fluid to the receptacle wall to push the piston downward and axially align the second port with the first port, flowing fluid from the chamber to an inner annular region between the housing and the pipe through the first and second ports such that downward movement of the piston terminates, and pushing the downhole tool from the first axial position to a second axial position with the actuation arm as the piston moves downward.

Embodiments may provide one or more of the following features.

In some embodiments, flowing the fluid from the chamber to the annular region includes equalizing a fluid pressure within the chamber and the inner annular region.

In some embodiments, the actuation arm includes a contact member that applies a force to the downhole tool, the contact member defining multiple slots.

In some embodiments, the method further includes flowing fluid upward from the downhole tool through the multiple slots and into the inner annular region.

In some embodiments, the method further includes displacing fluid from a region below the downhole tool upward and into the downhole tool.

In some embodiments, the method further includes axially aligning an inner port extending radially through the downhole tool with an outer port extending radially through the pipe to allow fluid to flow out of the downhole tool, through the inner and outer ports, and into an outer annular region between the pipe and an outer wall surrounding the pipe.

The details of one or more embodiments are set forth in the accompanying drawings and description. Other features, aspects, and advantages of the embodiments will become apparent from the description, drawings, and claims.

DETAILED DESCRIPTION

Figure 1:
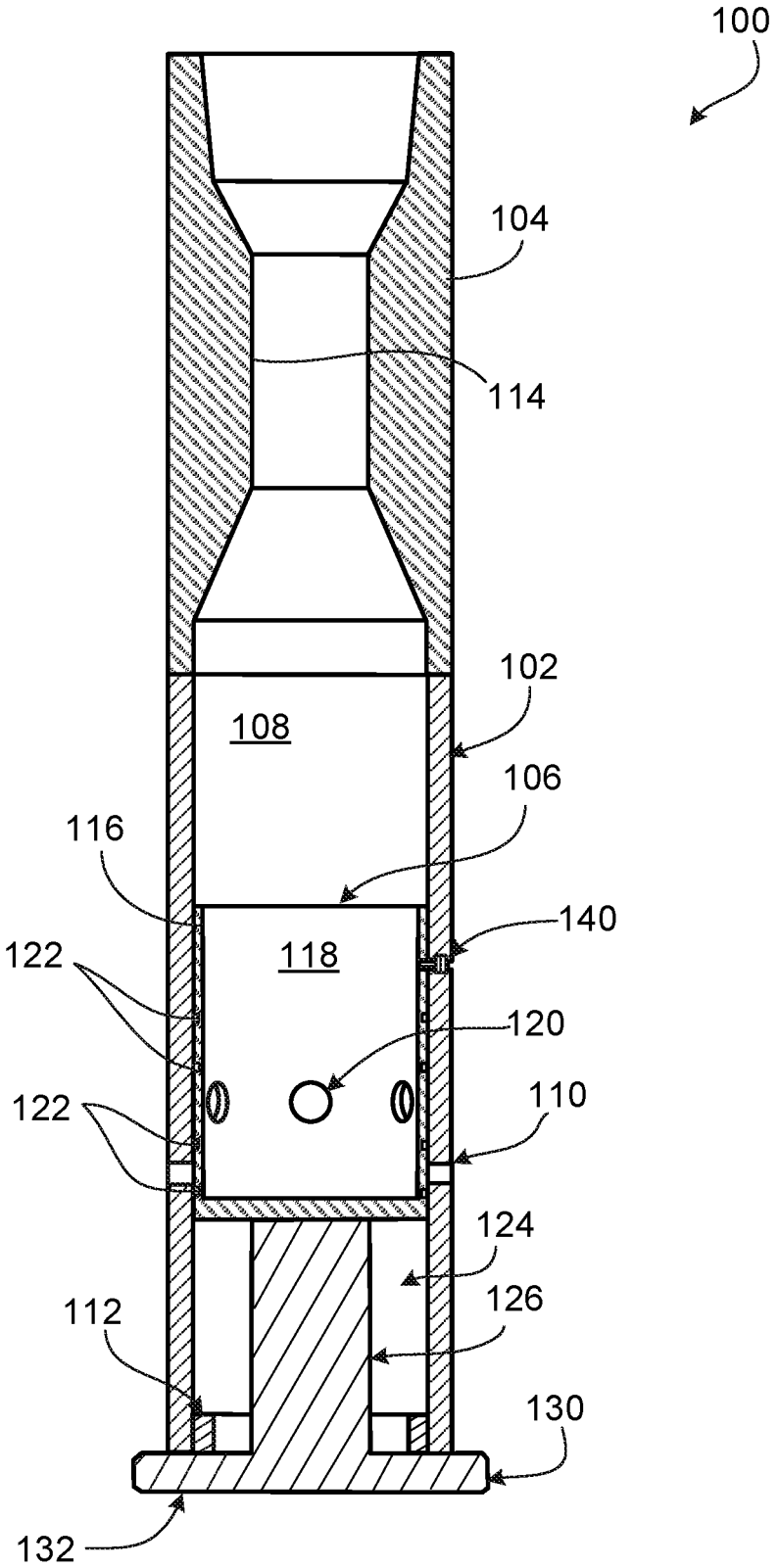
FIG. 1 is a cross-sectional view of a tool actuator in a deactivated state.
Figure 2:
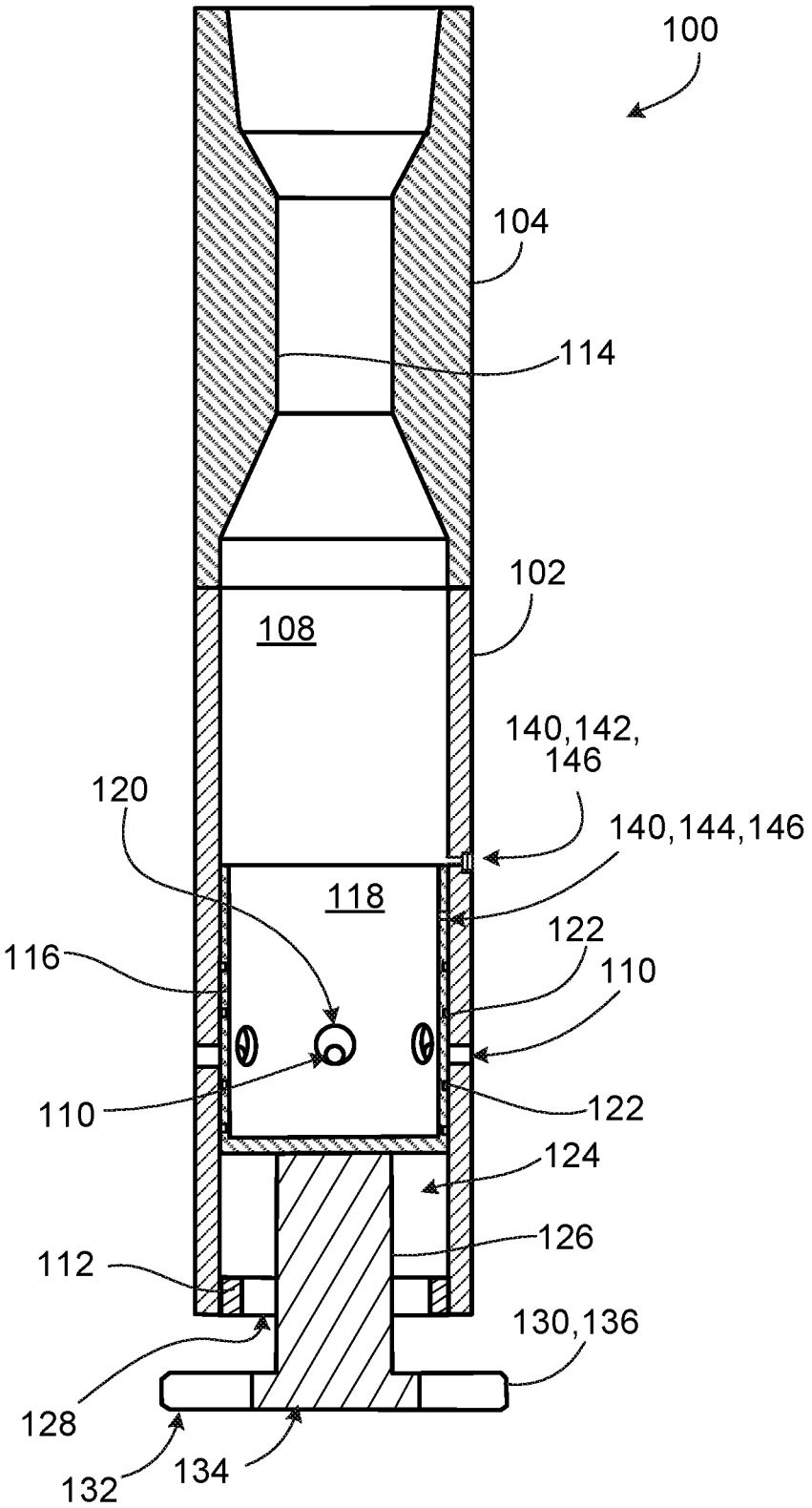
FIG. 2 is a cross-sectional view of the tool actuator of FIG. 1 in an activated state.
Figure 3:
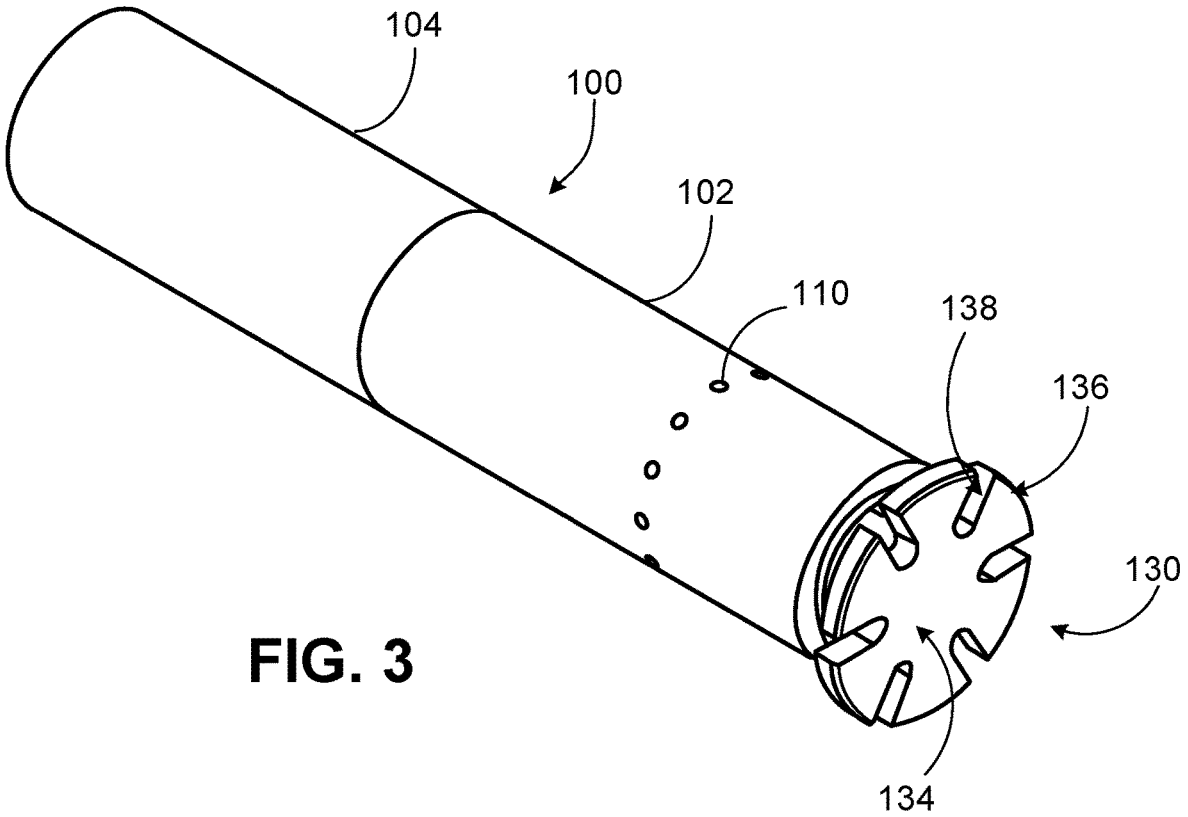
FIG. 3 is a perspective view of the tool actuator of FIG. 1 in the activated state.

FIGS. 1-4 illustrate a tool actuator 100 that is designed to move a downhole piston out of a hydraulically locked position (for example, a fixed position) during a downhole operation, such as a wellbore cementing operation or a process of actuating another downhole tool, such as a dart or ball that actuates a circulating sub in an environment where bit nozzles located below a circulation tool are plugged. The tool actuator 100 includes a generally cylindrical housing 102, a connector that 104 that extends upward from the housing 102 for connection to various running tools, and an actuator piston 106 that is movable axially within an axial bore 108 of the housing 102 to apply a downward force to the downhole piston for shifting the downhole piston out of the hydraulically locked position.

The housing 102 defines multiple fluid circulation ports 110 (for example, circular openings) that permit fluid communication between the axial bore 108 of the housing 102 and an annular region defined between the housing 102 and a surrounding wall, such as a casing or a formation wall along an open hole of a wellbore. The housing 102 also defines a circumferential flange 112 that functions as an axial stop for the actuator piston 104. The connector 104 is provided as a generally tubular elongate wall that defines an inner profile 114 with a variable diameter for mating with various running tools that form a drill string. Example running tools on which the tool actuator 100 may be deployed include drill collars, drill pipes, coil tubing, and wireline (for example, e-line).

The actuator piston 106 includes a receptacle wall 116 that defines an open fluid chamber 118 and multiple fluid circulation ports 120 (for example, circular openings) that may be aligned axially with the fluid circulation ports 108 of the housing 102 to permit fluid communication between the fluid chamber 118 and the annulus surrounding an external surface of the housing 102. The actuator piston 106 also includes multiple circumferential seals 122 (for example, annular seals) that are carried on the receptacle wall 116 for isolating the fluid circulation ports 120 on the receptacle wall 116 from the fluid circulation ports 110 on the housing 102 to prevent fluid communication between the fluid chamber 118 and the axial bore 108 of the housing 102. The actuator piston 106 is movable axially within the axial bore 108 of the housing 102 until the receptacle wall 116 abuts the flange 112 (for example, during deployment of the tool actuator 100 to a downhole piston.

Figure 4:
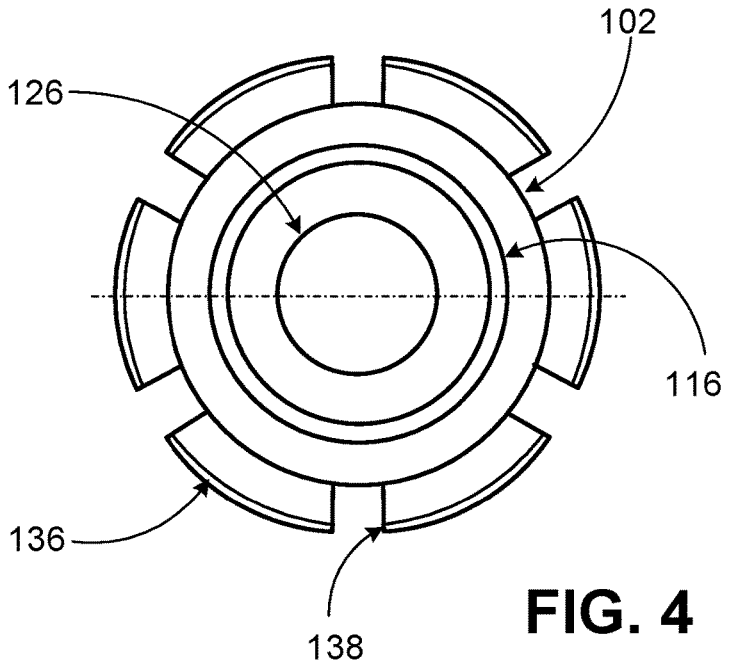
FIG. 4 is a top view of the tool actuator of FIG. 1.

The actuator piston 106 also includes an actuation arm 124 for actuating the downhole piston. The actuation arm 124 includes a shaft 126 that extends from the receptacle wall 116 and through an opening 128 of the housing 102 and a contact member 130 disposed at the end of the shaft 126. The contact member 130 provides a contact surface 132 at which the actuator piston 106 can contact the downhole piston to push the downhole piston out of the locked position in a controlled manner. Referring particularly to FIG. 4, the contact member 130 defines a central region 134 and multiple projections 136 that extend radially from the central region 134. The projections 136 are spaced apart by multiple slots 138 that allow fluid to flow upward from the downhole piston through the opening 128 into the tool actuator 100 and upward into the annular region that surrounds the tool actuator 100, as will be discussed in more detail below. In some embodiments, the actuator piston 106 additionally includes an attachment mechanism by which the tool actuator 100 can be secured to the downhole piston at a feature along an inner circumference of the downhole piston.

Figure 5:
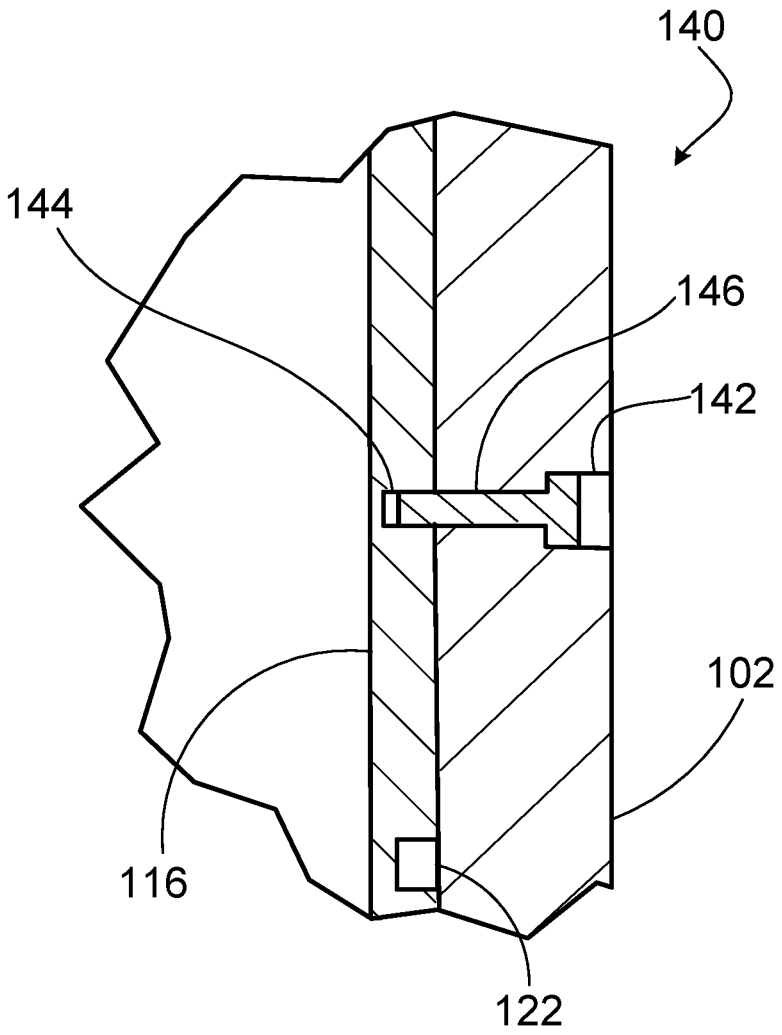
FIG. 5 is an enlarged cross-sectional view of a locking mechanism of the tool actuator of FIG. 1 in the deactivated state.

Referring to FIG. 5, the housing 102 and the receptacle wall 116 of the actuator piston 106 together provide a locking mechanism 140 that can prevent axial movement of the actuator piston 106 within the housing 102 while the tool actuator 100 is being deployed within the wellbore. The locking mechanism 140 includes an insertion groove 142 in the housing 102, a corresponding terminal groove 144 in the receptacle wall 116, and a shear pin 146 that is initially disposed within both the insertion groove 142 and the terminal groove 144. The shear pin 146 locks the actuator piston 106 to the housing 102 as long as any force applied to the receptacle wall 116 (for example, a weight of any fluid within the fluid chamber 118) remains below a threshold force (for example, during deployment of the tool actuator 100). Once the threshold force of the applied force is exceeded (for example, once the weight of any fluid within the fluid chamber 118 exceeds the threshold force), then the force causes the receptacle wall 116 to move downward, thereby breaking an end portion of the shear pin 146 that is subsequently retained within the terminal groove 142 during axial movement of the receptacle wall 116. The threshold force is typically within a range of about 200 Newtons (N) to about 5000 N.

In some embodiments, the housing 102 has a length that is in a range of about 0.4 meters (m) to about 4 m and an inner diameter (for example, defining a diameter of the axial bore 108) that in a range of about 0.04 m to about 0.25 m. In some embodiments, the fluid circulation ports 110 in the housing 102 have a diameter that is in a range of about 0.25 cm centimeters (cm) to about 2.00 cm and are typically spaced substantially equidistantly apart. In some embodiments, the receptacle wall 116 of the actuator piston 106 has a length that is in a range of about 0.05 m to about 0.51 m and an inner diameter (for example, defining a diameter of the fluid chamber 118) that is in a range of about 0.25 m to about 0.48 m. In some embodiments, the fluid circulation ports 120 in the receptacle wall 116 have a diameter that is in a range of about 0.5 cm] cm to about 5.1 cm and are typically spaced substantially equidistantly apart. In some embodiments, the actuation arm 124 of the actuator piston 106 has a total length that is in a range of about 0.05 m to about 0.51 m. In some embodiments, the contact member 130 has a thickness that is in a range of about 5 cm to about 51 cm and a diameter that is in a range of about 0.05 m to about 0.51 m. In some embodiments, the slots 138 within the contact member 130 have a length that is in a range of about 1.2 cm to about 13 cm and a width that is in a range of about 0.5 cm to about 2.1 cm. In some embodiments, the various components of the tool actuator 100 may be made one or more metal materials, such as alloy steel or a nickel-chromium-based superalloy. The components of the tool actuator 100 may be made of the same one or more materials or may have different material compositions between the components.

Figure 6:
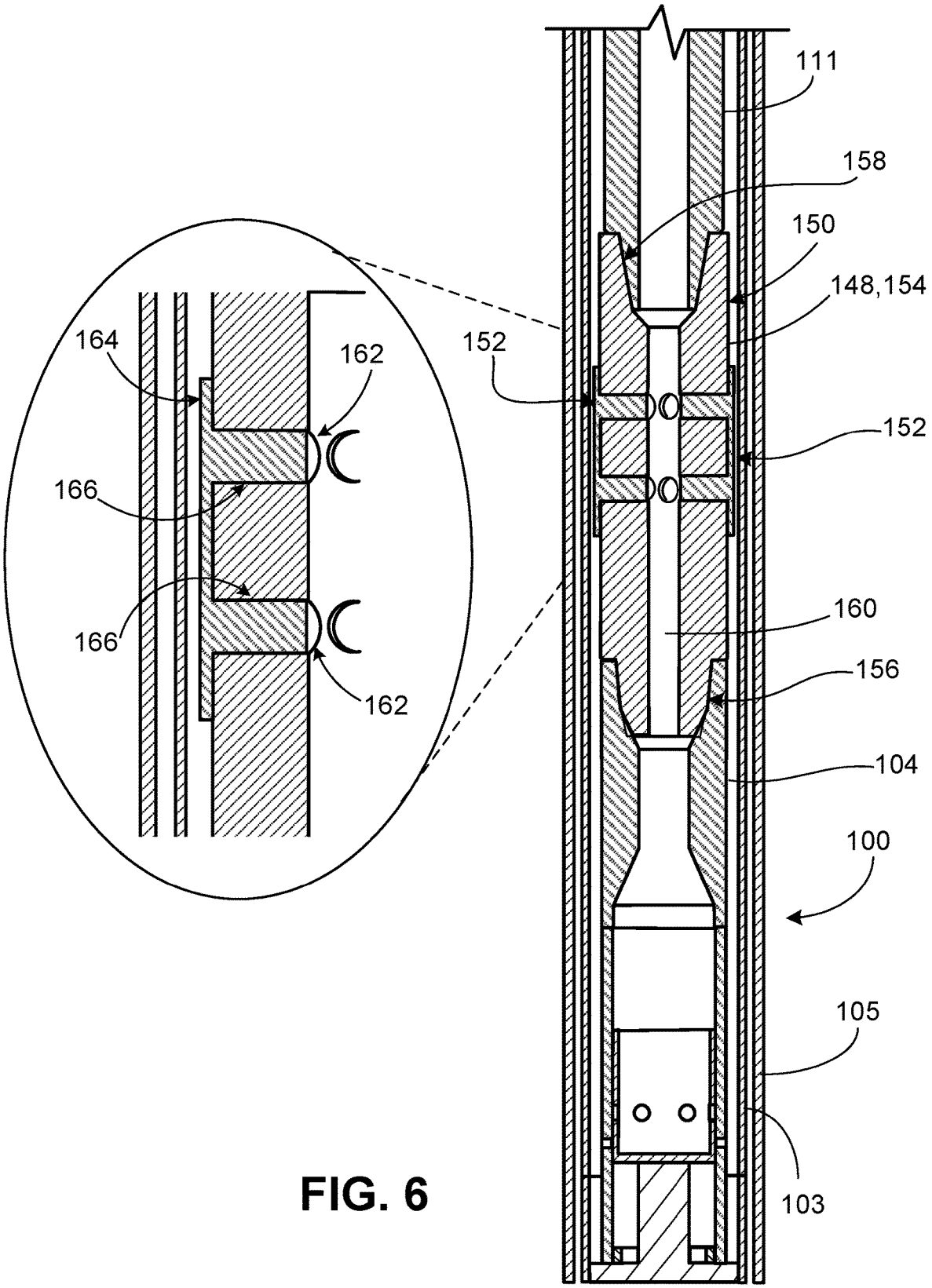
FIG. 6 is a cross-sectional view of an optional anchor tool of the tool actuator of FIG. 1, with the anchor tool in an closed position.
Figure 7:
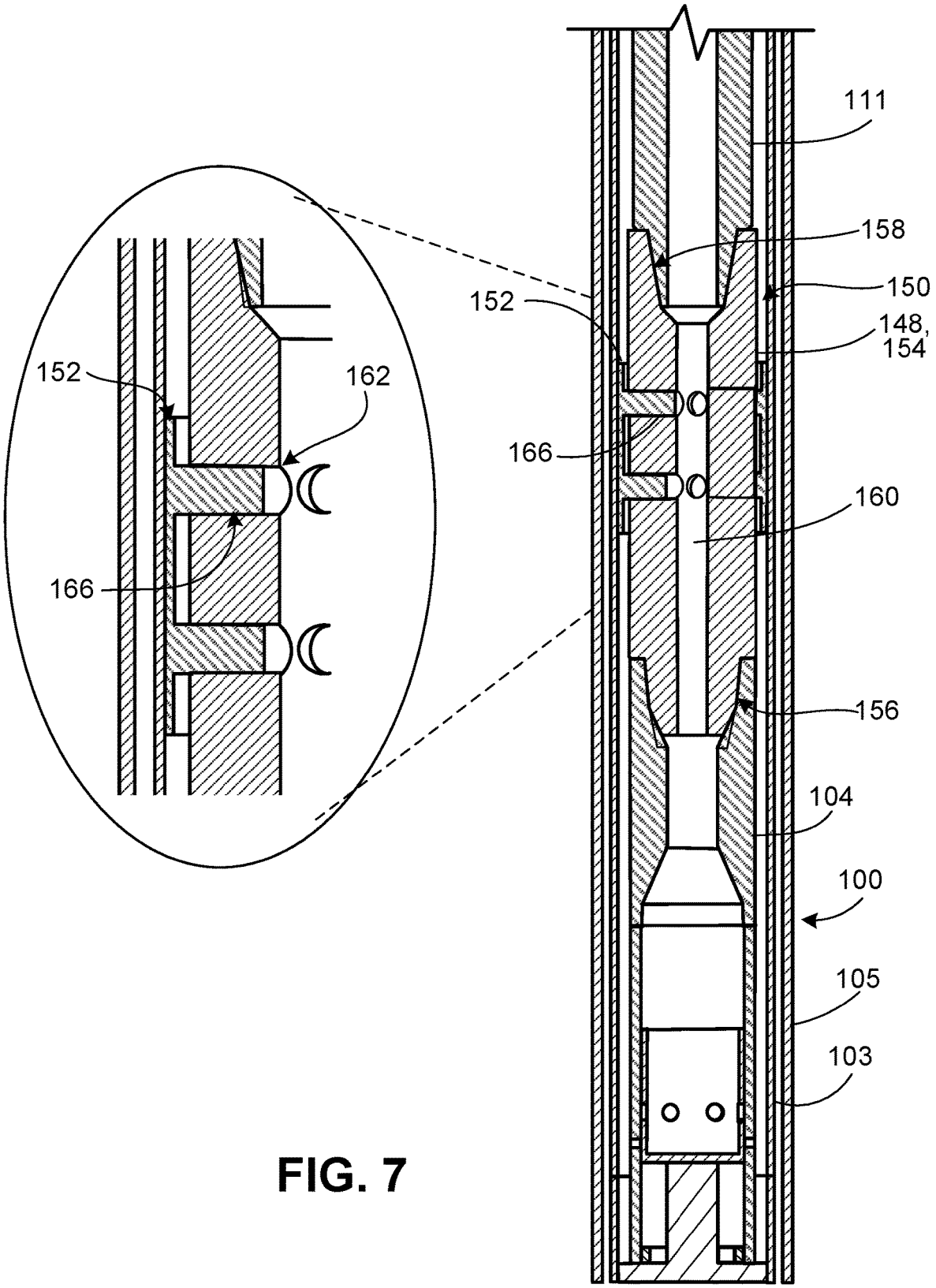
FIG. 7 is a cross-sectional view of the anchor tool of FIG. 6 in an open position.

FIGS. 6 and 7 illustrate an optional anchor tool 150 of the tool actuator 100 that may be used to prevent axial movement of the tool actuator 100 within a pipe segment 103 (for example, a casing joint) disposed within an outer casing joint 105 at a wellbore. In some implementations, the pipe segment 103 may be disposed directly within a wellbore such that a formation wall defining the wellbore serves as the outer tubular structure. The anchor tool 150 includes an anchor body 148 that is mated with the connector 104 of the tool actuator 100 and multiple locking devices 152 that are carried on the anchor body 148. The anchor body 148 includes a generally tubular wall 154 that defines an outer end profile 156 for mating with the connector 110 of the tool actuator 100 and an inner end profile 158 for mating with one or more serially arranged running tools 111. The tubular wall 154 also defines a central channel 160 that passes fluid from a running tool 111 to the tool actuator 100, as well as multiple sets of lateral through openings 162 that extend from the central channel 160.

Each locking device 152 includes a contact pad 164 and two protrusions 166 that extend from the contact pad 164 into the through openings 162 in the anchor body 148. The protrusions 166 are movable within the through openings 162 by a fluid pressure within the central channel 160 to move the locking device 152 from a closed position to an open position.

In the closed position (refer to FIG. 6), the fluid pressure is less than a threshold pressure required to push the locking device 152 radially outward from the tubular wall 154, such as during deployment of the tool actuator 100. Therefore, the contact pad 164 is positioned against the tubular wall 154 and spaced apart from the pipe segment 103 to allow axial movement of the tubular wall 154, and accordingly, the tool actuator 100 connected to the tubular wall 154.

In the open position (refer to FIG. 7), the fluid pressure is sufficient to push the locking device 152 radially outward from the tubular wall 154, such that the contact pad 164 is spaced apart from the tubular wall 154 and snuggly positioned against the pipe segment 103 to secure the tubular wall 154 to the pipe segment 103 in a fixed axial position, and accordingly, to prevent axial movement of the tool actuator 100, such as during operation of the tool actuator 100.

Figure 8:
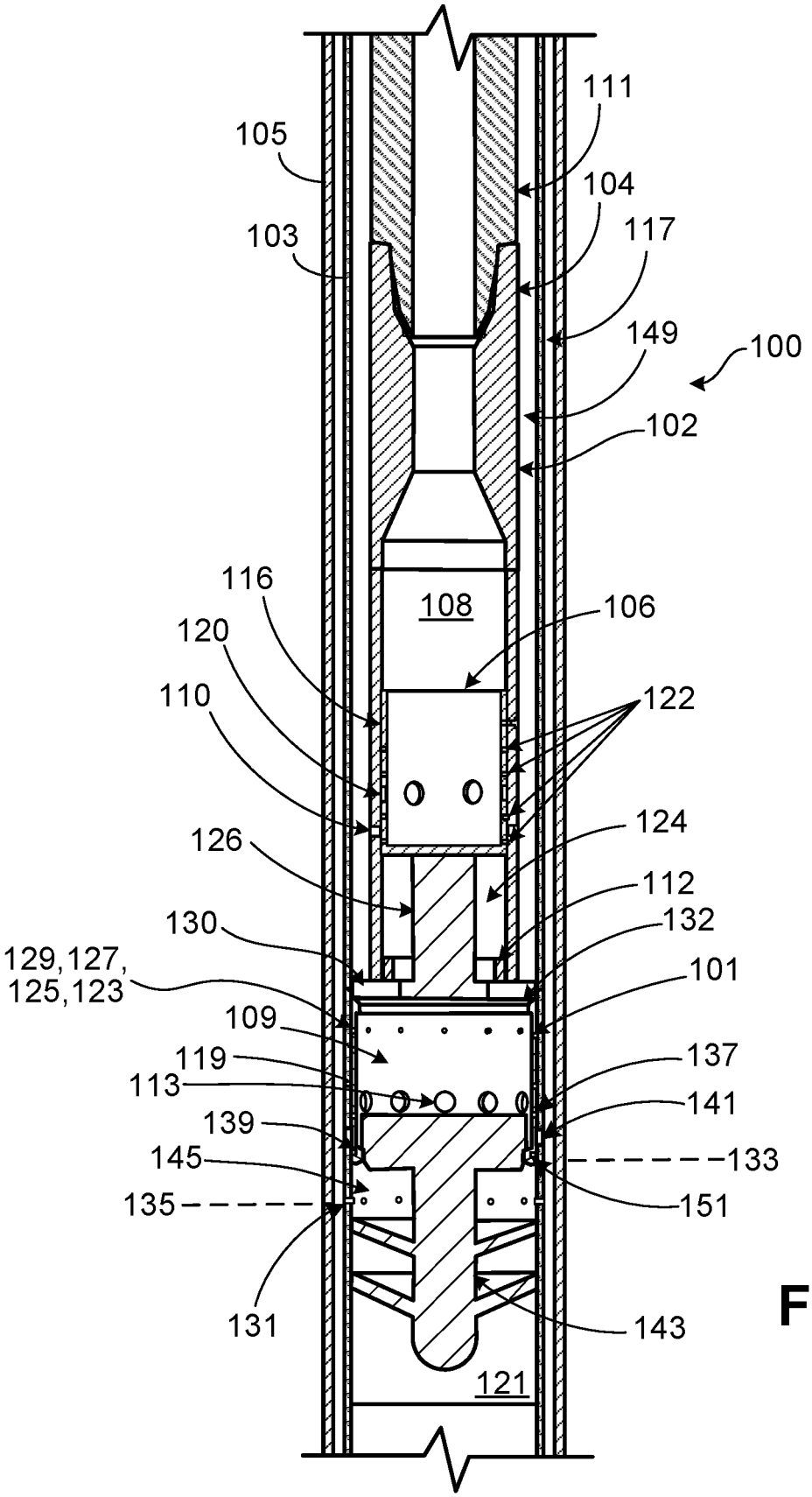
FIG. 8 is a cross-sectional view of the tool actuator of FIG. 1 positioned above a downhole piston that is hydraulically locked within a pipe segment.

FIG. 8 illustrates the tool actuator 100 positioned above a downhole piston 101 that is hydraulically locked within the pipe segment 103, with fluid (for example, one or more of water, brine, cement, or drilling mud) above the downhole piston 101 and below the downhole piston 101. The tool actuator 100 is deployed to the downhole piston 101 once the hydraulically locked condition is recognized at a driller's console at the surface of the wellbore 105. Once the tool actuator 100 is deployed, a weight gauge at the driller's console can detect a reduction in weight of the drill string, which indicates that the tool actuator 100 has reached the downhole piston 101. Accordingly, the tool actuator 100 may be engaged with downhole piston 101 without any weight or with very little weight applied from the drill string to the downhole piston 101. In other embodiments, the housing 102 of the tool actuator 100 may be equipped with sensors that transmit a signal to the driller's console indicating that the tool actuator 100 has reached the downhole piston 101.

In some embodiments, the downhole piston 101 is a differential valve (DV) tool that is used to carry out a cementing operation at the wellbore. The downhole piston 101 includes a receptacle wall 107 that defines an open fluid chamber 109 and multiple fluid circulation ports 113 (for example, circular openings) that may be aligned axially with multiple fluid circulation ports 115 of the pipe segment 103 during certain stages of operation of the downhole piston 101 to permit fluid communication between the fluid chamber 109 and an annular region 117 (for example, an annulus) defined between pipe segment 103 and the outer casing joint 105. The receptacle wall 107 also defines a circumferential flange 139 that functions as an axial stop, as will be discussed in more detail below. The downhole piston 101 further includes multiple circumferential seals 119 (for example, annular seals) that are carried on the receptacle wall 107 for isolating the fluid circulation ports 103 on the receptacle wall 107 from the fluid circulation ports 115 on the pipe segment 103 to prevent fluid communication between the fluid chamber 109 and an axial bore 121 of the pipe segment 103 during certain other stages of operation of the downhole piston 101.

The pipe segment 103 and the receptacle wall 107 of the downhole piston 101 together provide multiple, circumferentially spaced locking mechanisms 123 that locate a first axial position 133 of the downhole piston 101 at which the fluid circulation ports 113 of the downhole piston 101 are closed (for example, blocked off by the wall of the pipe segment 103 such that the downhole piston 101 is deactivated). Similar to the locking mechanism 140, each locking mechanism 123 includes an insertion groove 125 in the pipe segment 103, a corresponding terminal groove 127 in the receptacle wall 107, and a shear pin 129 disposed within both the insertion groove 125 and the terminal groove 127. The shear pin 129 locks the downhole piston 101 to the pipe segment 103 at the first axial position as long as any force applied to the receptacle wall 107 (for example, a weight of any fluid within the fluid chamber 109) remains below a threshold force.

The pipe segment 103 also carries multiple, circumferentially spaced stoppers 131 (for example, shear pins) that define a second axial position 135 of the downhole piston 101 at which the downhole piston 101 is activated so that one or more operations (for example, second-stage operations, such as a second-stage cementing process or a process of actuating another downhole tool, such as a dart or ball) can be carried out at the downhole piston 101. In order to shift the downhole piston 101 from the first axial position 133 to the second axial position 135 at which the receptacle wall 107 rests on the multiple stoppers 131, a dart 137 can be pumped down through fluid (for example, one or more of water, brine, cement, or drilling mud) in the axial bore 121 of the pipe segment 103 and into the fluid chamber 109 of the downhole piston 101. The dart 137 includes a base 141 that is sized to seat at the flange 139 and a leading shaft 143 that extends from the base 141. As the dart 137 moves down into the fluid chamber 109, fluid in a region 145 below the downhole piston 101 is displaced by the leading shaft 143 of the dart 137 and moves upward into the fluid chamber 109 around the dart 137 and through an opening 147 defined by the flange 139. The downhole piston 101 can continue to move downward as long as the dart 137 moves downward to displace the fluid from the region 145 into the fluid chamber 109.

In some cases, the fluid pressure within the region 145 below the downhole piston 101 and a fluid pressure within the fluid chamber 109 may equalize such that the base 141 of the dart 137 seats snuggly on the flange 139. Fluid within the region 145 is prevented from flowing upward into the fluid chamber 109, and fluid pressure above the downhole piston 101 cannot overcome the fluid pressure within the region 145 to push the downhole piston 101 downward any further, such that the downhole piston 101 becomes stuck (for example, hydraulically locked) at the first axial position 133. In the hydraulically locked state, the downhole piston 101 is prevented from reaching the second axial position 135 to facilitate the intended second-stage operations.

The tool actuator 100 can be deployed on the running tools 111 to the downhole piston 101 to move the downhole piston 101 out of the hydraulically locked state at the first axial position 133. A fluid pressure P1 is applied by the fluid to the tool actuator 100 to move the tool actuator 100 downward within the pipe segment 103, while fluid within an annular region 149 (for example, an annulus) between the tool actuator 100 and the pipe segment 103 is open to atmospheric pressure P2. As the tool actuator 100 is moved downward, fluid within the pipe segment 103 is displaced upward through the slots 138 of the contact member 130 of the actuator piston 106 into the fluid chamber 118. At any of these stages, the fluid may be one or more of water, brine, cement, or drilling.

Figure 9:
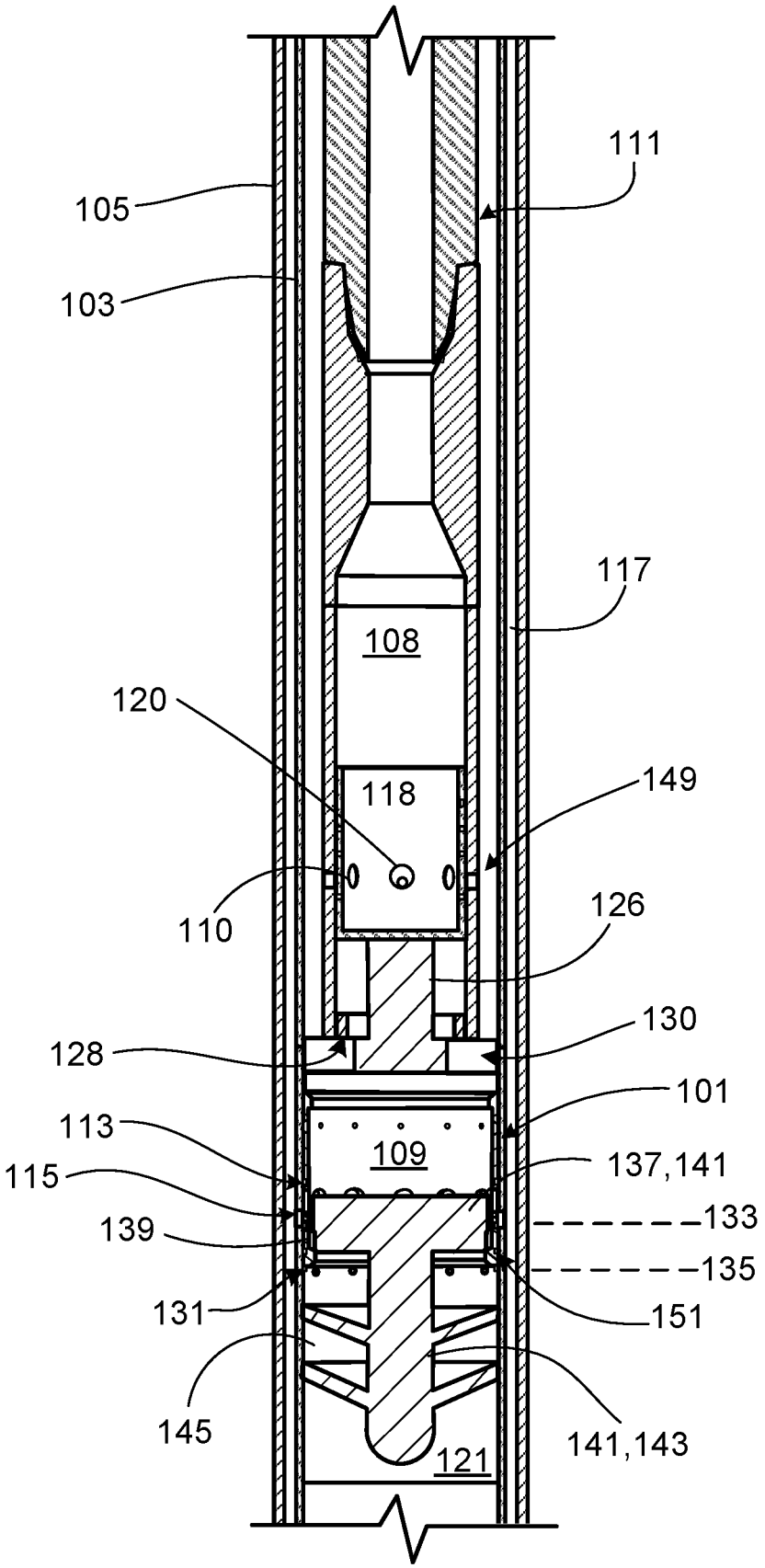
FIG. 9 is a cross-sectional view of the tool actuator of FIG. 1 positioned above the downhole piston as shown in FIG. 8, with the downhole piston shifted from a hydraulically locked position to an operational position within the pipe segment.

Referring to FIG. 9, once the pressure of the fluid within the fluid chamber 118 exceeds the threshold pressure for overcoming the locking mechanism 140, then the actuator piston 106 is moved downward, such that the fluid circulation ports 120 on the receptacle wall 116 align with the fluid circulation ports 110 on the housing 102. Alignment of the fluid circulation ports 110, 120 opens the fluid circulation ports 120 to allow fluid (for example, cement or drilling mud) to flow from the fluid chamber 118 into the annular region 149, thereby reducing the fluid pressure within the tool actuator 100 until that pressure equalizes with the fluid pressure within the annular region 149 at a fluid pressure P3.

Equalization of the fluid pressures prevents further downward movement of the actuator piston 106, such that a travel distance of the actuator piston 106 is carefully controlled to smoothly push the downhole piston 101, in the hydraulically locked state at the first axial position, from the first axial position 133 to the second axial position 135, but not past the second axial position 135. Controlled movement of the downhole piston 101 from the first axial position 133 to the second axial position 135 ensures that the operations intended to occur at the second axial position 135 are not inadvertently skipped (for example, bypassed), as often occurs when utilizing conventional mechanisms to resolve a hydraulically locked state of a downhole piston. Accordingly, the tool actuator 100 is operable to recover the downhole piston 101 from a hydraulically locked state in a manner that ensures that the planned second-stage operations can occur.

In some instances, a drop in pressure within the tool actuator 100 can provide confirmation of a successful actuation stroke of the actuator piston 106. Additional confirmation may be obtained by closing the annular region 149 at the surface by, for example, engaging a blowout preventer over the running tools 111, circulating fluid inside of the running tools 111, and observing no change in pressure within the running tools 111 or the annular region 149 and no flow between the annular region 149 and the tool actuator 100. Accordingly, at this stage, the fluid flow should be visible at the surface from the annular region 117.

Figure 10:
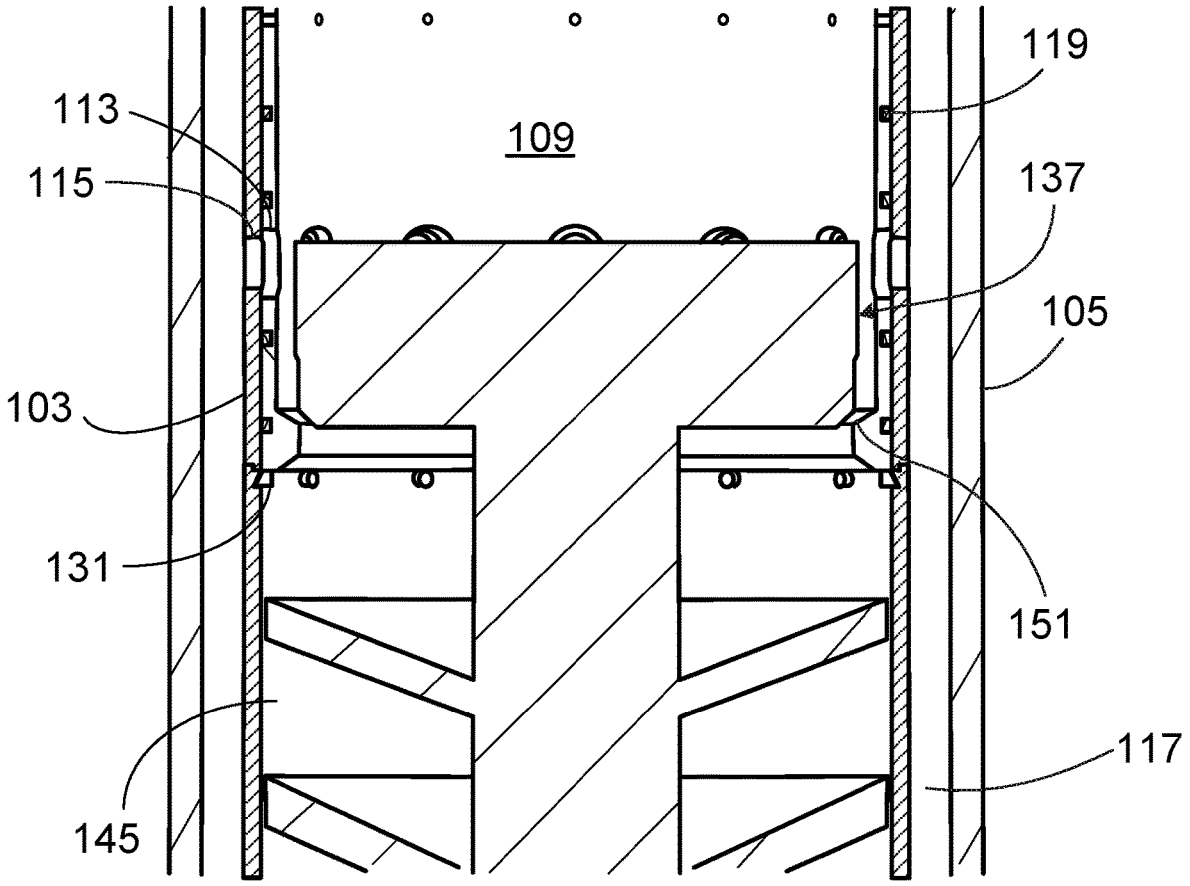
FIG. 10 is an enlarged cross-sectional view of a dart suspended above a seat of the downhole piston in the operational position of FIG. 9.

Referring to FIG. 10, as the downhole piston 101 moves from the first axial position 133 to the second axial position 135, the dart 137 unseats from the flange 139 to float upward freely within the fluid chamber 109, thereby opening up a flow path 151 along which fluid within the region 145 below the downhole piston 101 can flow into the fluid chamber 109. Upward displacement of the fluid from the region 145 allows the downhole piston 101 to move in the downhole direction until the downhole piston 101 reaches the second axial position 135 at the stoppers 131. At the second axial position 135, the fluid circulation ports 113 of the downhole piston 101 are also aligned with the fluid circulation ports 115 of the pipe segment 103. Alignment of the fluid circulation ports 113, 115 opens the fluid circulation ports 113 and thereby places the fluid chamber 109 in fluid communication with the annular region 117 such that fluid (for example, water, brine or cement) flows out of the fluid chamber 109 into the annular region 117 to allow displacement of cement from the surface through the annular region 149 into the annular region 117. The tool actuator 100 should be removed with running tools 111 from the annular region 149 before pumping cement.

Figure 11:
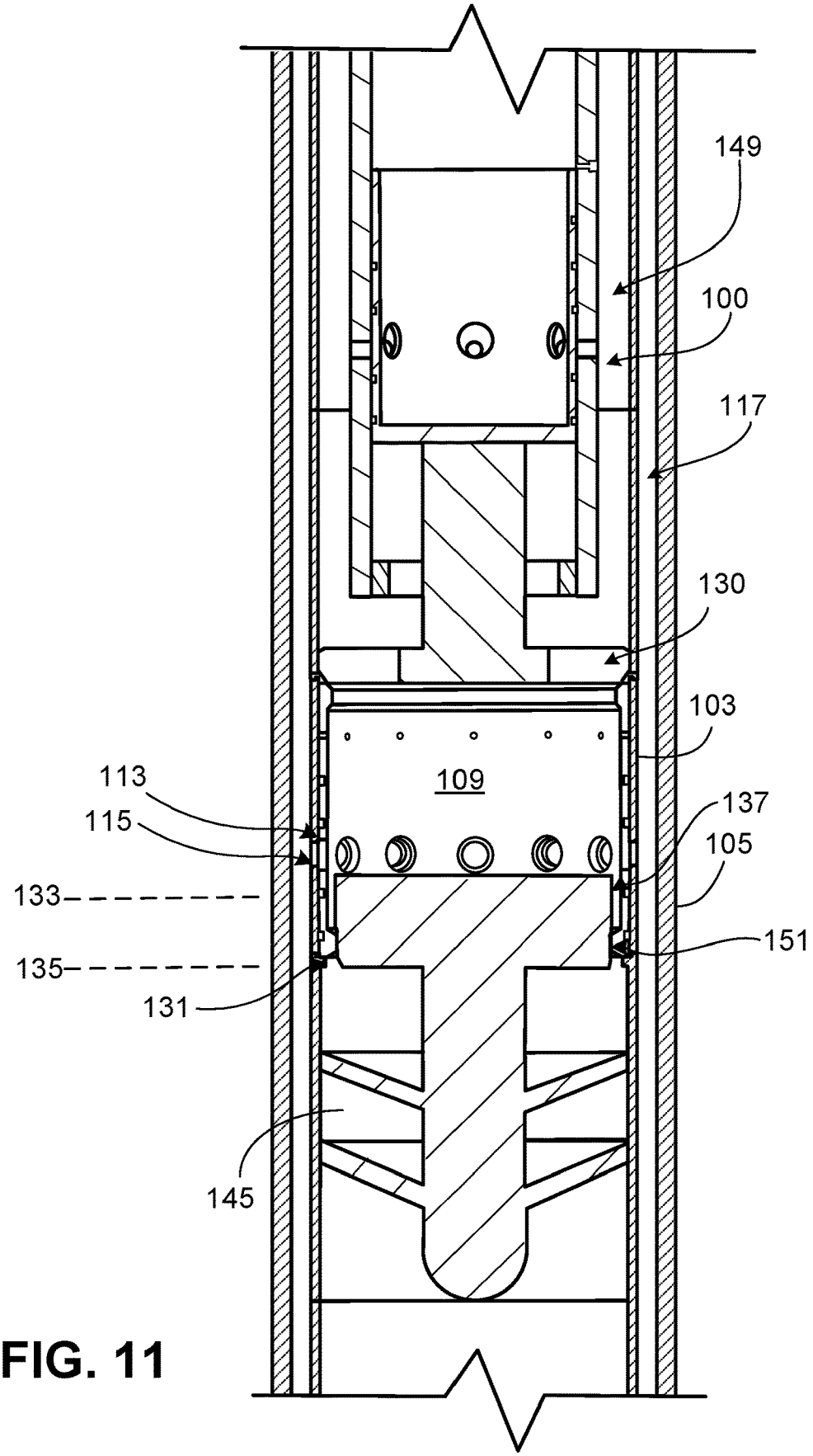
FIG. 11 is an enlarged cross-sectional view of the dart of FIG. 10 positioned on the seat of the downhole piston in the operational position of FIG. 9.

Referring to FIG. 11, the dart 137 eventually settles back downward to the flange 139 of the receptacle wall 107 while the downhole piston 101 remains at the second axial position 135, thereby sealing the region 145 below the downhole piston 101 and the fluid chamber 109 within the downhole piston 101 so that the second-stage operations can be carried out via the downhole piston 101 at the second axial position 135. Upon successful actuation of the actuator piston 106 and subsequent sealing of the region 145, the tool actuator 100 is retrieved by pulling the running tools 111, carrying the tool actuator 100, to the surface. Following completion of the second-stage operations, a subsequent dart may be dropped from the surface to shift the downhole piston 101 to yet a lower axial position (for example, a third axial position) to again close the fluid circulation ports 113 of the downhole piston 101 when at the lower axial position.

In instances where the actuation stroke of the actuator piston 106 is not successful, further measures may be undertaken to actuate the downhole piston 101. For example, weight may be added to an uphole end of one or more of the housing 102 of the tool actuator 100, the connector 104, or the running tools 111 to increase the force acting on the downhole piston 101. In some examples, the anchor tool 150 may be placed in the open state (refer to FIG. 6) to prevent excessive upward movement of the tool actuator 100 during actuation.

Figure 12:
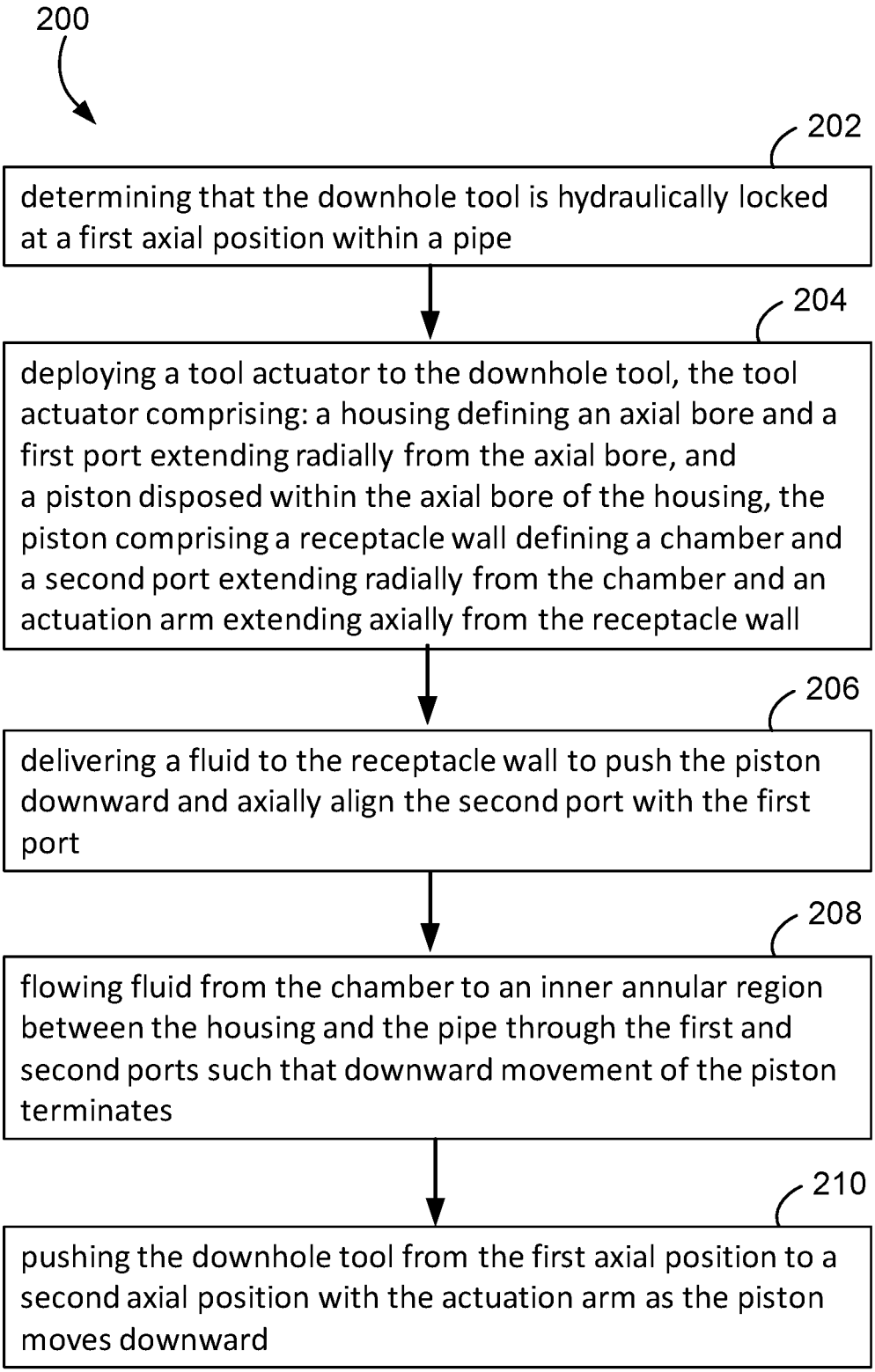
FIG. 12 is a flow chart illustrating an example method of moving a downhole tool using the tool actuator of FIG. 1.

FIG. 12 is a flow chart illustrating an example method 200 of moving a downhole tool (for example, the downhole piston 101). The method 200 includes determining that the downhole tool is hydraulically locked at a first axial position (for example, the first axial position 133) within a pipe (for example, the pipe segment 103) (202) and deploying a tool actuator (for example, the tool actuator 100) to the downhole tool (204). In some embodiments, the tool actuator includes a housing (for example, the housing 102) defining an axial bore (for example, the axial bore 108) and a first port (for example, a fluid circulation port 110) extending radially from the axial bore and a piston (for example, the actuator piston 106) disposed within the axial bore of the housing, the piston including a receptacle wall (for example, the receptacle wall 116) defining a chamber (for example, the fluid chamber 118) and a second port (for example, a fluid circulation port 120) extending radially from the chamber and an actuation arm (for example, the actuation arm 124) extending axially from the receptacle wall. In some embodiments, the method 200 further includes delivering a fluid to the receptacle wall to push the piston downward and axially align the second port with the first port (206). In some embodiments, the method 200 further includes flowing fluid from the chamber to an inner annular region (for example, the annular region 149) between the housing and the pipe through the first and second ports such that downward movement of the piston terminates (208). In some embodiments, the method 200 further includes pushing the downhole tool from the first axial position to a second axial position (for example, the second axial position 135) with the actuation arm as the piston moves downward (210).

While the downhole tool actuator 100 has been described and illustrated with respect to certain dimensions, sizes, shapes, arrangements, materials, and methods 200, in some embodiments, a downhole tool actuator that is otherwise similar or substantially similar in construction and function to the downhole tool actuator 100 may include one or more different dimensions, sizes, shapes, arrangements, and materials or may be utilized according to different methods. For example, in some embodiments, a tool actuator that is otherwise similar to the tool actuator 100 may be designed for electromechanical actuation (for example, electric motor actuation), as opposed to actuation that occurs by mechanical force application from a drill string. Such embodiments may include a housing with a different shape, include its own power supply (for example, batteries), be run on wireline or e-line, and exclude certain other features, such as one or more fluid circulation ports or a locking mechanism.

Accordingly, other embodiments are also within the scope of the following claims.

What is claimed is:

1. A downhole tool actuator comprising:

a housing defining an axial bore and a first port extending radially from the axial bore; and a piston disposed and movable within the axial bore of the housing, the piston comprising:

a receptacle wall defining a chamber and a second port extending radially from the chamber, a shaft extending axially from the receptacle wall, and a contact member extending across the shaft, positioned outside of the housing, being wider than the housing, and configured to engage a downhole tool.

2. The downhole tool actuator of claim 1, wherein the housing further defines a stopper disposed within the axial bore at a downhole end of the axial bore.

3. The downhole tool actuator of claim 1, wherein axial movement of the piston within the axial bore is limited by the stopper.

4. The downhole tool actuator of claim 1, wherein the contact member is oriented horizontally.

5. The downhole tool actuator of claim 1, wherein the contact member defines a plurality of slots that extend radially with respect to the shaft.

6. The downhole tool actuator of claim 1, wherein the piston further comprise a first seal carried on the receptacle wall and a second seal carried on the receptacle wall, the first seal positioned above the second port and the second seal positioned below the second port.

7. The downhole tool actuator of claim 6, wherein the piston is movable to:

a first position at which the second port is located above the first port and the first and second seals block fluid communication between the first and second ports; and a second position at which the second port is axially aligned with the first port such that the fluid chamber is in fluid communication with a region outside of the housing.

8. The downhole tool actuator of claim 1, wherein the housing defines a plurality of first ports that are spaced about a circumference of the housing and the receptacle wall defines a plurality of second ports that are spaced about a circumference of the receptacle wall.

9. The downhole tool actuator of claim 8, wherein the plurality of first ports is radially aligned with the plurality of second ports.

10. The downhole tool actuator of claim 1, further comprising a locking mechanism that is configured to secure the receptacle wall of the piston to the housing.

11. The downhole tool actuator of claim 10, wherein the locking mechanism comprises a pin that is disposed within the housing and the receptacle wall.

12. The downhole tool actuator of claim 1, further comprising a connector extending from the housing and configured to be coupled to a running tool, the connector defining a channel that fluidly communicates with the axial bore of the housing.

13. The downhole tool actuator of claim 1, further comprising an anchor tool extending from the housing and configured to secure the housing to an exterior wall surrounding the housing, the anchor tool defining a channel that fluidly communicates with the axial bore of the housing.

14. A method of moving a downhole tool, the method comprising:

determining that the downhole tool is hydraulically locked at a first axial position within a pipe;

deploying a tool actuator to the downhole tool, the tool actuator comprising:

a housing defining an axial bore and a first port extending radially from the axial bore, and a piston disposed within the axial bore of the housing, the piston comprising a receptacle wall defining a chamber and a second port extending radially from the chamber and an actuation arm extending axially from the receptacle wall;

delivering a fluid to the receptacle wall to push the piston downward and axially align the second port with the first port;

flowing fluid from the chamber to an inner annular region between the housing and the pipe through the first and second ports such that downward movement of the piston terminates; and pushing the downhole tool from the first axial position to a second axial position with the actuation arm as the piston moves downward.

15. The method of claim 14, wherein flowing the fluid from the chamber to the annular region comprises equalizing a fluid pressure within the chamber and the inner annular region.

16. The method of claim 14, wherein the actuation arm comprises a contact member that applies a force to the downhole tool, the contact member defining a plurality of slots.

17. The method of claim 16, further comprising flowing fluid upward from the downhole tool through the plurality of slots and into the inner annular region.

18. The method of claim 14, further comprising displacing fluid from a region below the downhole tool upward and into the downhole tool.

19. The method of claim 18, further comprising axially aligning an inner port extending radially through the downhole tool with an outer port extending radially through the pipe to allow fluid to flow out of the downhole tool, through the inner and outer ports, and into an outer annular region between the pipe and an outer wall surrounding the pipe.

20. A downhole tool actuator comprising:

a housing defining an axial bore and a first port extending radially from the axial bore; and a piston disposed and movable within the axial bore of the housing, the piston comprising:

a receptacle wall defining a chamber and a second port extending radially from the chamber, a shaft extending axially from the receptacle wall, and a contact member extending across the shaft, defining a plurality of slots that extend radially with respect to the shaft, being positioned outside of the housing, and being configured to engage a downhole tool.

* * * * *